US006763624B2

(12) United States Patent
Gow

(10) Patent No.: US 6,763,624 B2
(45) Date of Patent: Jul. 20, 2004

(54) SIGN APPARATUS

(76) Inventor: Thomas W. Gow, 1039 109$^{th}$ Ave. NW., Coon Rapids, MN (US) 55448

( * ) Notice: Subject to any disclaimer, the term of this patent is extended or adjusted under 35 U.S.C. 154(b) by 0 days.

(21) Appl. No.: 10/263,803

(22) Filed: Oct. 2, 2002

(65) Prior Publication Data

US 2004/0064991 A1 Apr. 8, 2004

(51) Int. Cl.$^{7}$ ..... G09F 13/00
(52) U.S. Cl. ..... 40/560; 40/570; 353/62
(58) Field of Search ..... 40/570, 560; D16/221; 362/147; 353/62, 101

(56) References Cited

U.S. PATENT DOCUMENTS 2,200,959 A * 5/1940 Land ..... 359/498
3,743,401 A * 7/1973 Johannsen et al. ..... 353/52
5,140,301 A * 8/1992 Watanabe ..... 40/560
5,570,138 A * 10/1996 Baron ..... 348/744
5,768,814 A 6/1998 Kozek et al. ..... 40/570
5,797,673 A 8/1998 Logan et al. ..... 362/234
6,181,251 B1 * 1/2001 Kelly ..... 340/628
6,350,042 B1 * 2/2002 Lai ..... 362/277

* cited by examiner

*Primary Examiner*—Gary Hoge
(74) *Attorney, Agent, or Firm*—Nawrocki, Rooney & Sivertson, P.A.

(57) ABSTRACT

This invention provides a sign image by projecting light through a replaceable pivotable image forming apparatus onto an adjacent surface. The apparatus is contained within a telescoping tube of three locking sections with overlap indicators. The tube is pivotably mounted within a wall or ceiling. The pivotable tube and stencil permits projecting the sign image onto an adjacent inclined surface. The first section has a light source at its outer end and image forming apparatus which provides the sign message. The other two sections each contain a lens for respective image size and focus adjustment by changing the sections overlaps.

8 Claims, 3 Drawing Sheets

SIGN APPARATUS

BACKGROUND OF THE INVENTION

1. Field of the Invention

This invention relates in general to sign apparatus, and relates in particular to emergency sign apparatus within a building required by law to indicate an exit.

2. Description of the Related Art

There are a variety of signs used in buildings to provide emergency exit signs. These signs are made of a variety of materials, including various metals and plastics, which are mounted on a building ceiling or wall. There are a number of objections to this arrangement. A sign mounted on a wall is subject to damage from a variety of sources, which can even include vandalism. Further, architects consider these signs to be objectionable in appearance. These signs are produced in many different directional arrow configurations that require excessive production of various configurations and can result in potential mistakes in shipping. The proper configuration for any information could be solved by a universal field modified sign adaptable to any configuration. It would be desirable if an exit sign could be concealed completely within a wall or ceiling and still provide the required information, since such an arrangement would eliminate all of the above objections.

SUMMARY OF THE INVENTION

This invention provides a sign, which is mounted completely within the surface of a wall or ceiling, which projects the desired message on an adjacent surface including a wall, the ceiling or a suspended surface.

The sign information is displayed by projecting the desired message on the surface. The projected message is obtained by directing a light source through image forming apparatus. Typical image forming apparatus can include replaceable image lens or stencil. The projection apparatus is mounted within a telescoping tube having three sections. The outer end of the first section mounts the light source and an adjacent image forming apparatus. The second center section, and the third section each mount a lens at the light entrance end. The lenses are arranged such that changing the overlap of the first and second section will change the size of the resulting projected image, and changing the overlap of the second and third section will change the focus of the resulting projected image. The second and third sections have indices along their exterior to respectively indicate the overlap of the first and second sections and the overlap of the second and third sections. Both the overlapped first and second section, and the overlapped second and third section can be locked together at various amounts of overlap.

When the image forming apparatus is a stencil, the stencil is pivotably mounted across the tube cross-section. Opposed projections from the stencil apparatus extends through opposed slots in the tube. A scale around one of the slots and the relationship of the projections to the slots indicates the angular relationship of the stencil to a perpendicular pair of axis which are contained in a plane perpendicular to the tube axis. This information assists in orienting the projected image relative to the receiving surface, which will be described further later.

The adjacent planar surfaces receiving the image are normally inclined with respect to the projection apparatus. The adjacent surfaces can be a wall, the ceiling or a suspended surface. The mounting apparatus for the tube mounts the tube within a circular opening at an angle with respect to the surface of a wall or ceiling. An outwardly extending flange, which has a central opening, is the only part of the mounting apparatus which is external to the opening.

The mounting apparatus is symmetrical about the mounting hole, which permits the apparatus to be mounted at any angle around a line perpendicular to the flange opening. This permits the tube to be mounted with the projected image directed to either the right or left side, upward or downward, or at any angle in between. This permits directing the projected image on an adjacent side wall, the ceiling, or on a suspended surface. Because of the circular dimensions, only a single, relatively small size, circular hole is required to mount both the bracket and projection apparatus.

The first section has a light source located at its outer end, with the image forming apparatus mounted adjacent to the light source. The second and third section each have a lens mounted across their respective light entrance ends. Although any image forming means can be used, as indicated above it can be a stencil. The tube is installed at an angle with respect to the wall opening to permit projecting an image upon an inclined adjacent wall, ceiling or suspended surface.

In use, the mounting apparatus is oriented and the tube angle adjusted such that the projected image is directed onto the desired adjacent surface. The lenses are then adjusted by changing the relationship between the tube sections to focus the image upon this surface with the required size and the tube sections are locked relative to each other to maintain this desired relationship.

Since this apparatus is primarily intended to be used to indicate an exit, it is important that a power line failure not interrupt the projection of the image. The following two back-up power supply arrangements, among other similar arrangements, could be provided to essentially eliminate the possibility of a power interruption. Both would provide direct current power to the light source.

One power supply arrangement could use both a trickle charger and battery combination and a separate battery charger, with both being powered by a conventional alternating power source. The battery charger would provide direct current power to the light source and the trickle charger would maintain the battery at full charge. In the event of a power failure a relay could be used to open the battery charger circuit, disconnect the trickle charger from the battery and connect the battery to the light source to provide continuous direct current power for operation.

Another power supply arrangement could use a conventional alternating current power source and a back-up alternating current power source. Here the back-up could be either an engine-generator combination, or a battery-inverter combination with either providing alternating current of the same frequency and voltage as the conventional source, and arranged to turn on automatically upon failure of the conventional power source. A relay would switch from the conventional power source to the back-up source upon power failure, such that either of the above back-up power source arrangements would provide system power. A battery charger, which would normally be connected to the conventional power source, upon failure of the conventional power system, would be switched by a relay to the back-up source, such that either active source would provide direct current power to the light source.

Providing a back-up power supply arrangement similar to either of those described above, would insure that the projected message would probably never be interrupted.

Since the message is provided by projection, it can be made any desired size. Further, since a back-up power source arranged as those described above, could be provided for the event of a power line failure, it is extremely unlikely that there will ever be a failure in displaying the message. The total concealment of the sign apparatus, with only the exception of the flange, eliminates the problems with previous signs as to their vulnerability to damage and their appearance.

DETAILED DESCRIPTION OF THE INVENTION

Figure 1:
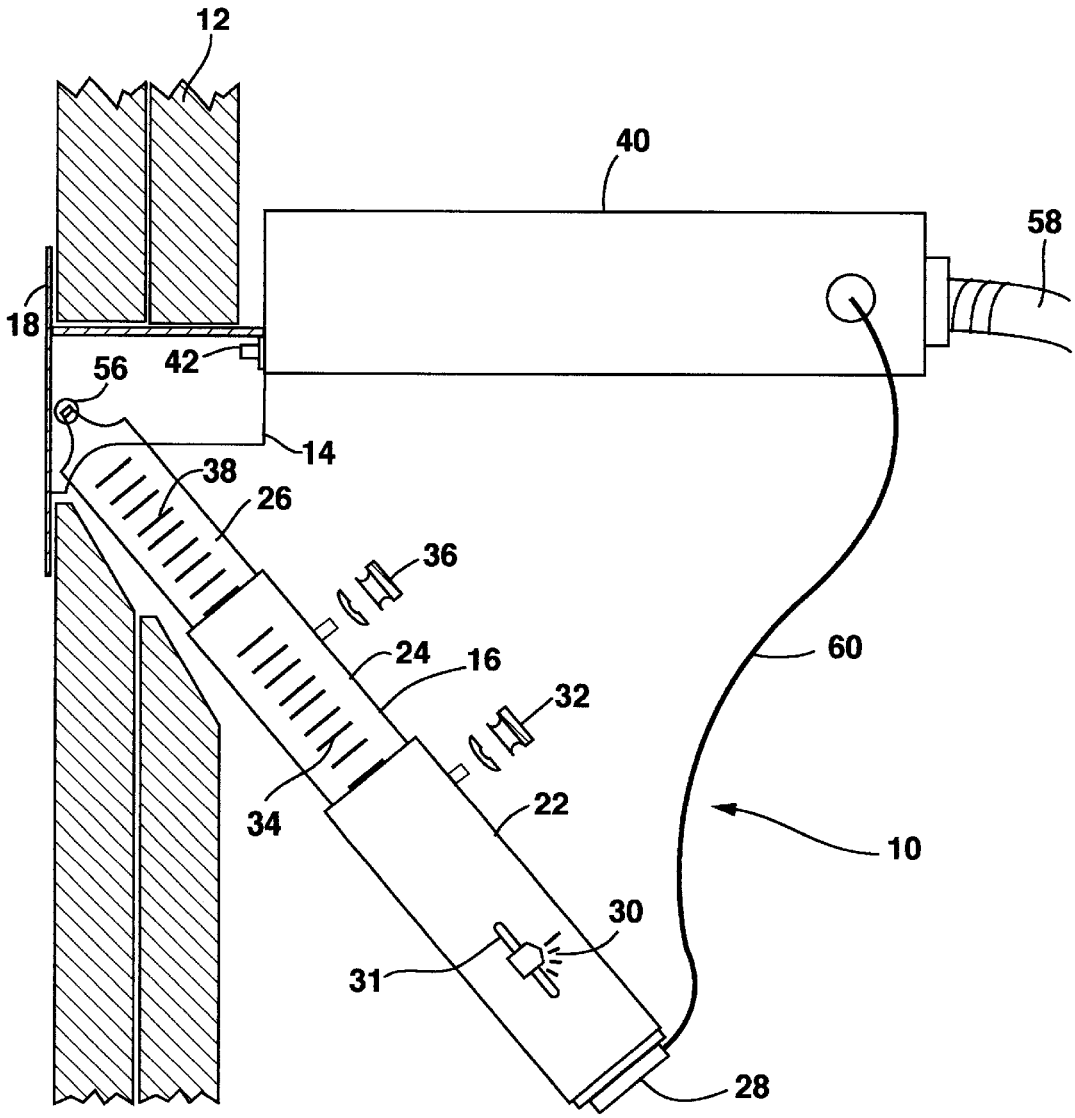
FIG. 1 is a top plan view of the present sign apparatus mounted within a ceiling.

FIG. 1 shows exit sign apparatus 10 mounted within a ceiling 12. A mounting bracket 14 secures a tube 16 pivotably in place by apparatus which will be described later. Flange 18 attached to bracket 14 is the only external part.

Tube 16, which is telescoping, is made up of a first section 22, a second section 24, and a third section 26 all extending along a central axis of tube 16. Tube 16 contains a light source 28 such as a high intensity LED mounted at the outer end of first section 22. First section 22 has an angular scale 30 and opposed slots 31. The purpose of scale 30 and slots 31 will be described later.

First section 22 and second section 24 have a first lock 32, and second section 24 and third section 26 have a second lock 36. Second section 24 has a first lineal scale 34, and third section 26 has a second linear scale 38 along its length. The purpose of these locks and scales will be described later.

Case 40, is provided for the system power supply, is attached to the rear of mounting bracket 14 by a bolt and nut 42, through aligned holes in the case and bracket, not shown. Arrangements for the power supply, contained in case 40, were described above. Cable 58 is provided to connect a power supply in case 40 to external power source(s) and cable 60 from the case to light source 28 provides power from the case to the light source.

Figure 2:
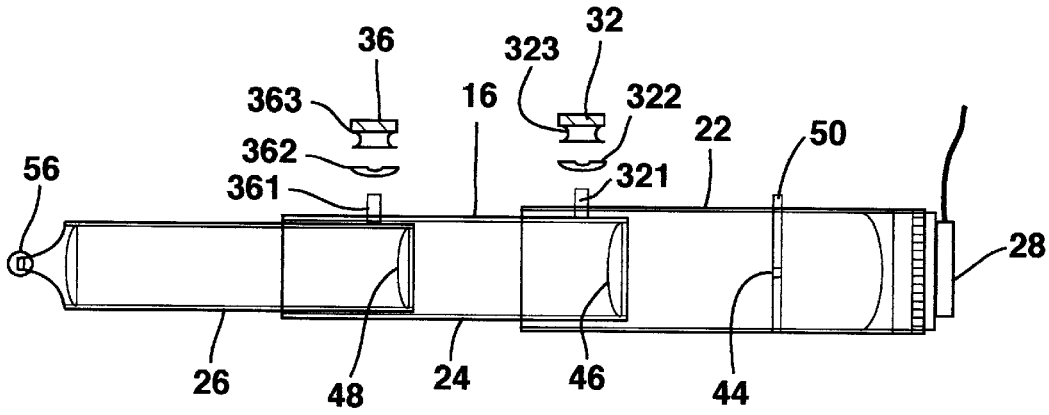
FIG. 2 is a side view of a portion of the interior of a tube within a cut-out region.
Figure 4:
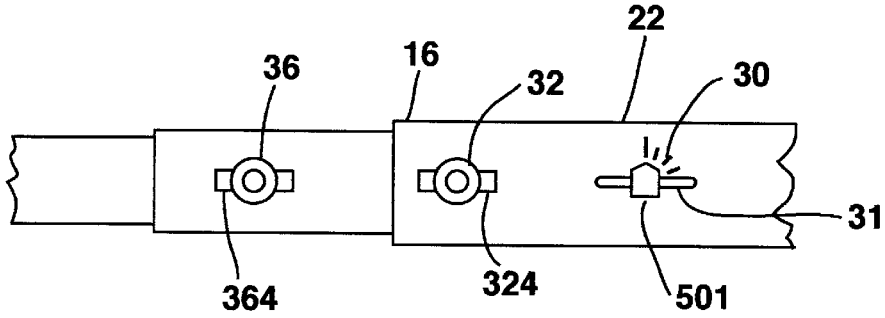
FIG. 4 is a top view of a portion of the tube.
Figure 3:
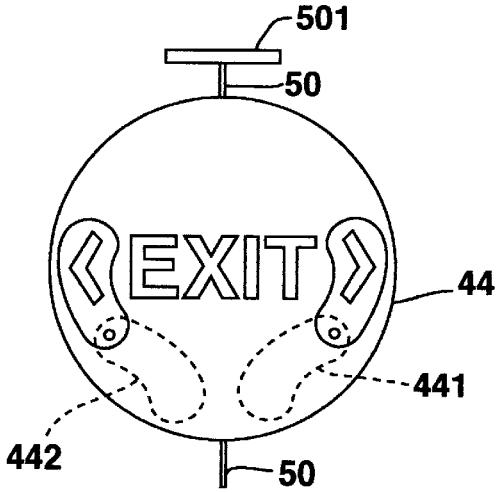
FIG. 3 is a detail of an image forming apparatus.
Figure 5:
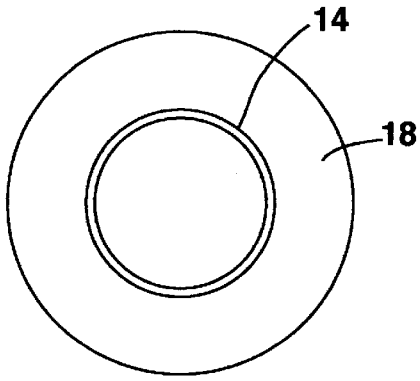
FIG. 5 is a top view of a flange.
Figure 6:
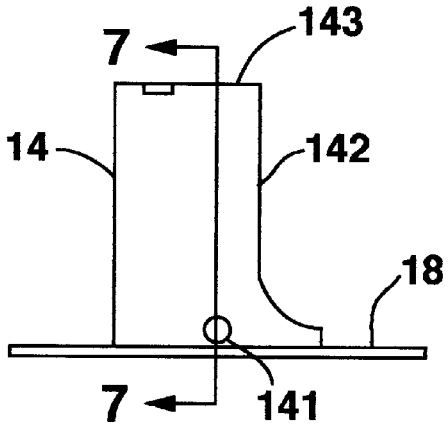
FIG. 6 is a side view of the mounting bracket.
Figure 7:
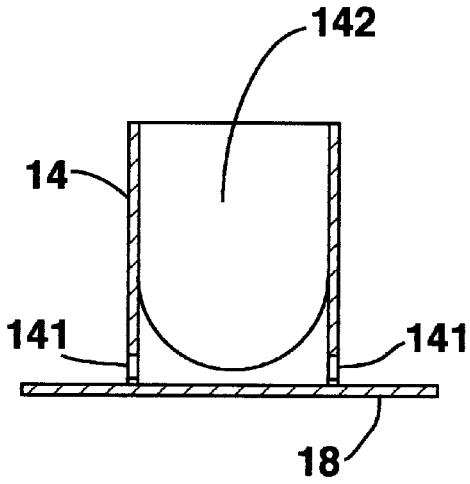
FIG. 7 is a cross-section along 7—7 of FIG. 6.
Figure 8:
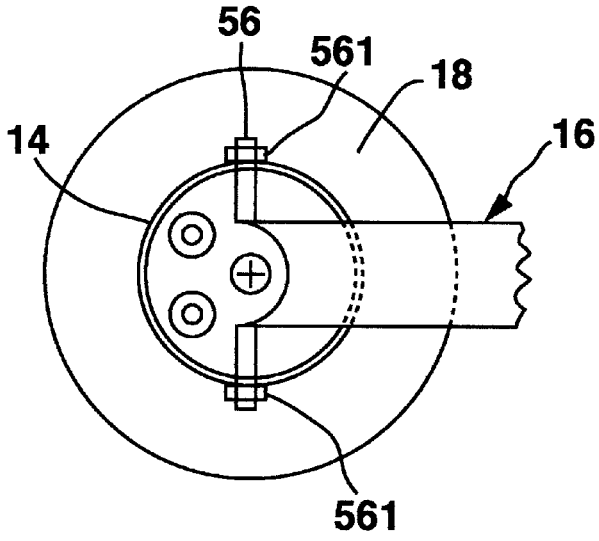
FIG. 8 is a bottom view of the mounting bracket, the flange and a portion of the tube.

FIGS. 2, 3 and 4, show tube 16, image forming apparatus consisting of a stencil 44, first lock 32, second lock 36, light source 28, a first lens 46 mounted across the light entry end of second section 24, a second lens 48 mounted across the light entry end of third section 26, and pin 50, which provides a two-axis pivot point for image forming apparatus 44. Pin 50 extends through opposing slots 31, and has a pointer 501 mounted perpendicular to the end adjacent to angular scale 30. Pointer 501 and angular scale 30 indicates the angle of image forming apparatus 44 with respect to tube 10 along one axis, and the location of the pointer within slots 31 indicates the angle along the second axis. This arrangement permits inclining the image forming apparatus 44 to conform to the angular relationship of the adjacent image receiving surface whether a wall, the ceiling or a suspended surface.

Image forming apparatus 44 contains the message "EXIT" in stencil form and has opposed indicator "V" shaped cut-outs on opposite sides to indicate a right or a left exit. Masks 441 and 442 are sized to cover the opposed direction indicators and are pivoted about rivets to permit covering or uncovering the indicators. The solid outlines of masks 441 and 442 indicate the covered positions and the dashed outlines indicate the uncovered positions. This arrangement provides means for customizing the sign in the field to select either a right or left exit indication by merely pivoting right or left masks 441 or 442 about its corresponding rivet to cover the adjacent V shaped cut-out. The rivets are arranged to be tight enough to secure masks 441 or 442 in the desired position against gravity. Image forming apparatus 44 containing other messages can also be substituted. Further, other image forming means can be mounted in the same location in the same way to permit changing its angular relationship with respect to tube 10.

First lock 32 is made up of bolt 321, lock washer 322 and nut 323. Bolt 321 is affixed to and extends outward through a hole in second section 24, not shown, then extends through slot 324 in first section 22. Slot 324 permits positioning first section 22 and second section 24 at different amounts of overlap. When nut 323 is secured over lock washer 322 and tightened on bolt 321, first section 22 is locked to second section 24.

A second lock is also made up of a bolt 361, a lock washer 362 and a nut 363. Bolt 361 is affixed to and extends outward through a hole in third section 26, not shown, then extends through slot 364 in third section 26. Slot 364 permits positioning third section 26 and second section 24 at different amounts of overlap. Lock 36 operates in the same manner as lock 32.

As described earlier, changing the overlap between first section 22 and second section 24, shown by first lineal scale 34, will change the size of the projected image, and changing the overlap between the second section 24 and the third section 26, shown by lineal scale 38, will change the focus of the projected image.

FIGS. 5, 6, 7 and 8 show mounting bracket 14 with its attached flange 18 and its relationship to tube 16. Mounting bracket 14 has two opposing holes 141, a side opening 142 and a rear surface 143.

Post 56, mounted on the end of tube 16, engages opposed holes 141 in mounting bracket 14 which permits pivoting tube 16. Post 56 is secured in place by friction secured push on connectors 561. Opening 142, in mounting bracket 14, provides pivoting space for tube 16 to permit changing the angular relationship between the tube and the surface of ceiling 12. This permits inclining tube 16 at the proper angle to project an image on a selected adjacent surface.

In use, when a stencil provides the message source, first the proper direction indication is provided by masking one of the AV@ shaped stencil indicators by pivoting the proper mask 441 to indicate the desired exit direction. The mounting bracket 14, containing apparatus 10, is then positioned within a wall or ceiling, as shown in FIG. 1, and the proper power connections made. With power provided to the apparatus, the inclination of tube 16 is then adjusted until the projected image is positioned at the desired location on the desired adjacent receiving surface. The projected image is carried in the light beam from source 28 traveling along the axis of tube 16. The angle of the image forming apparatus 44 is then adjusted, using angular scale 30 and the location of pin 50 within slot 31 and using the location of pointer 501 versus angular scale 30, to assist in acutely angling tube 16 with respect to ceiling 12 to place the projected image at the desired point on the wall. First lock 32 is then loosened and the overlap of sections 22 and 24 adjusted, using first lineal scale 24 as an aid, until the desired size image is obtained, whereupon the lock is tightened. Second lock 36 is then loosened and the overlap of sections 24 and 26 is adjusted, using second lineal scale as an aid, until the desired focus is obtained.

Once this adjustment is complete, light from source 28 will pass through apparatus 44 along the axis of tube 16 at an acute angle to ceiling 12. The pattern in apparatus 44 appears in focus and with the size desired on the surface against which the light from source 28 falls.

This apparatus, with the exception of flange 18 is located totally within ceiling 12. The ability to change the inclination, the size and focal length of the projected image permits projecting an image of any desired size on adjacent walls, ceiling or suspended surfaces. The sign message can be changed by merely substituting new apparatus 44 with a different message. The use of suitable power sources and either suggested power supply would essentially eliminate the problem of power failure, and the possibility of using either a battery or a separate power system for one emergency back-up system would provide additional flexibility. This arrangement permits field changes of the sign message and/or direction indication, eliminates the problem of damage or vandalism of the sign proper, and provides an enhanced appearance.

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. Sign apparatus comprising:

a) projection means for providing a projected image of a message, said projection means comprises a telescoping tube having a first section, a central second section and a third section, with the first section having a light source at its outer end and image forming apparatus mounted adjacent thereto, and with said second and said third section each having a lens mounted across the end adjacent to said light source; and b) mounting means for mounting said projection means inclined and concealed within a mounting surface such that said projected image exits at an angle therefrom.

2. Apparatus as in claim 1 having first locking means for locking the first section to the second section at various overlapped positions, and second locking means for locking the second section to the third section at various overlapped positions.

3. Apparatus as in claim 1 having first indicator means for indicating the amount of overlap of the first and the second sections and second indicator means for indicating the amount of overlap of the second and the third sections.

4. Sign apparatus comprising:

a) projection means for providing a projected image of a message along an axis; and b) mounting means for mounting said projection means upon a mounting surface to direct the projected image through the mounting surface with the axis acutely angled with respect to the mounting surface.

5. Apparatus as in claim 4 wherein said mounting means has means for changing the inclination of said projection means with respect to the mounting surface.

6. Apparatus as in claim 4 wherein said projection means comprises a telescoping tube having a first section, a central second section and a third section, with the first section having a light source at its outer end and image forming apparatus mounted adjacent thereto, and with said second and said third section each having a lens mounted across the end adjacent to said light source.

7. Apparatus as in claim 6 having first locking means for locking the first section to the second section at various overlapped positions, and second locking means for locking the second section to the third section at various overlapped positions.

8. Apparatus as in claim 6 having first indicator means for indicating the amount of overlap of the first and the second sections and second indicator means for indicating the amount of overlap of the second and the third sections.

* * * * *